United States Patent [19]

Hard

[11] 4,171,146

[45] Oct. 16, 1979

[54] RECOVERY OF SHALE OIL AND MAGNESIA FROM OIL SHALE

[75] Inventor: Robert A. Hard, Laguna Beach, Calif.

[73] Assignee: Occidental Research Corporation, Irvine, Calif.

[21] Appl. No.: 871,367

[22] Filed: Jan. 23, 1978

[51] Int. Cl.[2] ..... E21B 43/28; E21C 41/10

[52] U.S. Cl. ..... 299/2; 299/4

[58] Field of Search ..... 299/2, 4, 5

[56] References Cited

U.S. PATENT DOCUMENTS

| | | | |
|---|---|---|---|
| 235,236 | 12/1880 | Gutzkow | 423/165 |
| 2,954,218 | 9/1960 | Dew et al. | 299/4 |
| 3,130,960 | 4/1964 | Martin | 299/5 |
| 3,278,233 | 10/1966 | Hurd et al. | 299/4 |
| 3,455,796 | 7/1969 | Crumb | 204/70 |
| 3,502,372 | 3/1970 | Prats | 299/5 |
| 3,510,255 | 5/1970 | Hall et al. | 23/52 |
| 3,516,787 | 6/1970 | Van Nordstrand | 23/143 |
| 3,572,838 | 3/1971 | Templeton | 299/4 |
| 3,586,377 | 6/1971 | Ellington | 299/4 |
| 3,642,433 | 2/1972 | Dyni | 23/52 |
| 3,661,423 | 5/1972 | Garrett | 299/2 |
| 3,880,238 | 4/1975 | Tham et al. | 166/303 |
| 3,945,679 | 3/1975 | Closmann et al. | 299/5 |
| 4,016,239 | 4/1977 | Fenton | 423/155 |

OTHER PUBLICATIONS

U.S. Dept. Interior, Bureau of Mines Tech. Paper 684, H. A. Dorner et al., 1946.

*Primary Examiner*—Ernest R. Purser

*Attorney, Agent, or Firm*—Christie, Parker & Hale

[57] ABSTRACT

A fragmented permeable mass of formation particles containing oil shale and carbonates of calcium and magnesium is formed in an in situ oil shale retort. A combustion zone is advanced through the fragmented mass, whereby kerogen in oil shale in the fragmented mass is decomposed in a retorting zone on the advancing side of the combustion zone to produce gaseous and liquid products including shale oil, and particles containing retorted oil shale are combusted for converting magnesium values to more leachable form such as magnesium oxide. Magnesium values are leached from the combusted particles selectively with respect to calcium compounds and silicates with aqueous solutions of a purgeable, acid-forming gas such as carbon dioxide or sulfur dioxide. An enriched solution containing magnesium values is withdrawn from the fragmented mass and magnesia is recovered from such enriched solution.

71 Claims, 5 Drawing Figures

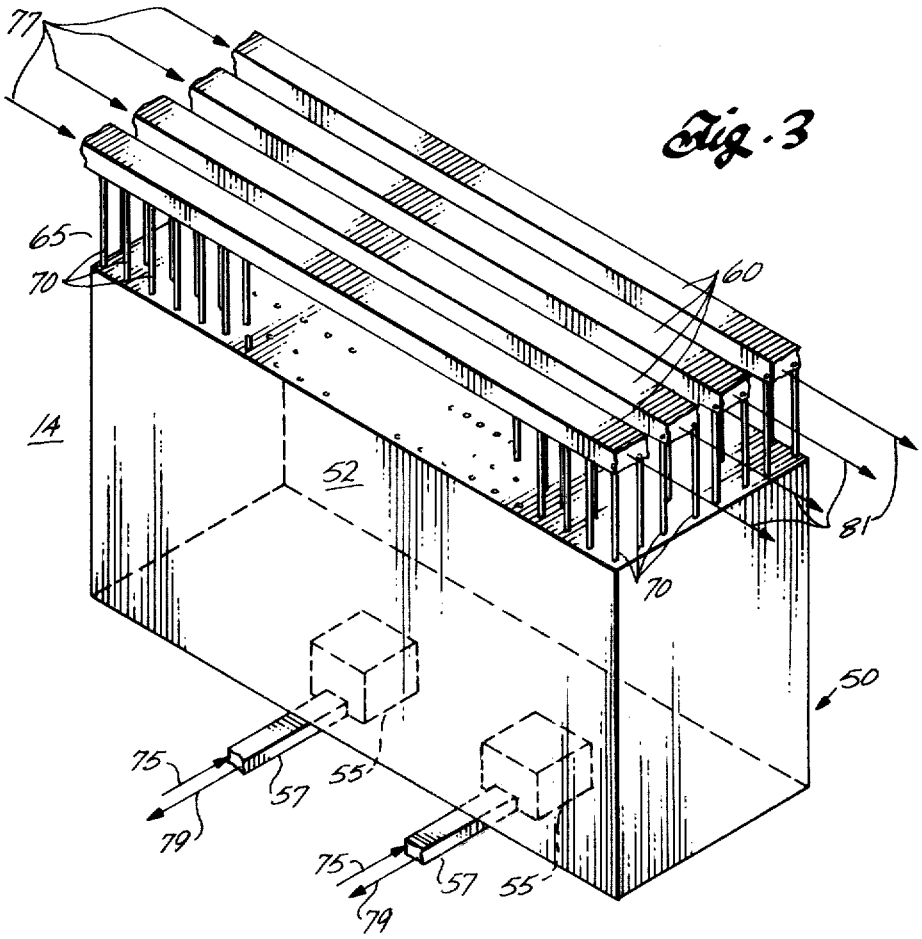
Fig. 3
Fig. 2
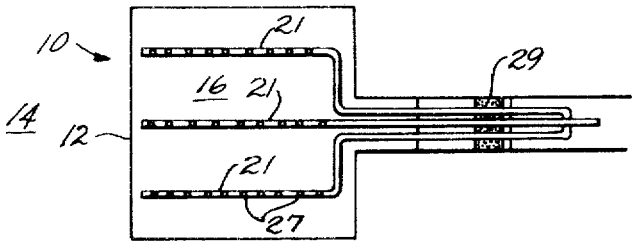

RECOVERY OF SHALE OIL AND MAGNESIA FROM OIL SHALE

BACKGROUND

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit having layers containing an organic polymer called "kerogen," which upon heating decomposes to produce hydrocarbon liquid and gaseous products. It is the formation containing kerogen that is called "oil shale" herein, and the liquid hydrocarbon product is called "shale oil."

A number of methods have been proposed for processing oil shale which involve either first mining the kerogen bearing shale and processing the shale above ground, or processing the oil shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972 to Donald E. Garrett, assigned to the assignee of this application, and incorporated herein by this reference. This patent describes in situ recovery of liquid and gaseous hydrocarbon materials from a subterranean formation containing oil shale by mining out a portion of the subterranean formation and then fragmenting a portion of the remaining formation to form a stationary, fragmented permeable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of an oxygen containing retort inlet mixture into the retort as a gaseous combustion zone feed to advance the combustion zone through the retort. In the combustion zone oxygen in the combustion zone feed is depleted by reaction with hot carbonaceous materials to produce heat and combustion gas. By the continued introduction of the gaseous combustion zone feed into the combustion zone, the combustion zone is advanced through the retort. The combustion zone is maintained at a temperature lower than the fusion temperature of oil shale, which is about 2100° F., to avoid plugging of the retort, and above about 1100° F. for efficient recovery of hydrocarbon products from the oil shale.

The effluent gas from the combustion zone comprises combustion gas, carbon dioxide from mineral carbonate decomposition, and any gaseous portion of the combustion zone feed that does not take part in the combustion process. This effluent gas is essentially free of free oxygen and contains constituents such as oxides of carbon, water vapor, nitrogen, and sulfurous compounds. It passes through the fragmented mass in the retort on the advancing side of the combustion zone to heat oil shale in a retorting zone to a temperature sufficient to produce kerogen decomposition, called retorting, in the oil shale to gaseous and liquid products and to a residue of solid carbonaceous material.

The liquid products and gaseous products are cooled by cooler particles in the fragmented mass in the retort on the advancing side of the retorting zone. The liquid hydrocarbon products, including shale oil, together with water produced in or added to the retort, are collected at the bottom of the retort and withdrawn to the surface through an access tunnel, drift or shaft. An effluent gas, referred to herein as off gas, containing combustion gas generated in the combustion zone, gaseous products including methane produced in the retorting zone, carbon dioxide from carbonate decomposition, and any gaseous portion of the combustion zone feed that does not take part in the combustion process is also withdrawn from the bottom of the retort.

Inorganic carbonates can be present in oil shale, notably carbonates of magnesium and calcium which decompose endothermically when heated to their decomposition temperatures. U.S. Pat. No. 4,036,299 to Cha, et al., assigned to the assignee of the present application and incorporated herein by this reference, describes a method of recovering shale oil from oil shale in an in situ oil shale retort in which a combustion zone is advanced through a fragmented permeable mass of formation particles containing oil shale and carbonates of magnesium and calcium. The patent discloses that the combustion zone is maintained at a temperature of from about 1100° F. to about 1400° F. (593°-760° C.), preferably from about 1200° F. to about 1300° F. (649°-704° C.), to obtain shale oil while avoiding excessive dilution of gaseous retorting products with carbon dioxide from decomposition of inorganic carbonates, notably calcium carbonate, in the oil shale.

Above-mentioned U.S. Pat. No. 3,661,423 to Garrett discloses briefly that mineral values can be leached from retorted oil shale in an in situ oil shale retort with water, acidic, or alkaline leaching agents. However, there is no description of the selective recovery of magnesium values from combusted oil shale in an in situ oil shale retort.

A number of patents have described the recovery of aluminum values from dawsonitic oil shale retorted above ground or by advancement of a combustion zone through an in situ oil shale retort, by leaching with aqueous leaching agents. Exemplary of these are U.S. Pat. Nos. 3,502,372 to Prats, 3,516,787 to Van Nordstrand, 3,572,838 to Templeton, 3,510,255 to Hall et al., and 3,642,433 to Dyni. The leaching agent typically is water or an alkaline aqueous solution, although the use of dilute acids has also been mentioned. The Van Nordstrand patent states that oil shale can contain from about 10 to 40 weight dolomite, and that dolomite in oil shale is decomposed upon retorting to form carbon dioxide, calcite, and magnesium oxide, the magnesium oxide tying up part of the silica in the oil shale to permit higher recovery of the aluminum values by leaching. Recovery of magnesium values it not disclosed in these patents.

The recovery of magnesium values from ground, calcined dolomite, a mineral form of calcium magnesium carbonate, is known. The selective leaching of magnesium values from dolomite calcined at 750°-850° C. with carbonated water has been described, for example, in U.S. Department of the Interior, Bureau of Mines Technical Paper 684, "The Bicarbonate Process for the Production of Magnesium Oxide," by H. A. Doerner et al (1946), the disclosure of which is incorporated herein by this reference. This paper describes the leaching of magnesium values from slurries of finely ground, calcined dolomite in well agitated mixing tanks.

The thermal decomposition of carbonates of magnesium and calcium in oil shale is described in E. J. Jukkola et al., "Thermal Decomposition Rates of Carbonates in Oil Shale," Industrial and Engineering Chemistry, 45 (1953), 2711-2714, which is incorporated herein by this reference. Data obtained by heating oil shale over a range of temperatures under various partial pressures of carbon dioxide are reported. Leaching of magnesium values from retorted oil shale is not described. A copy of the Jukkola, et al article accompanies this patent application.

SUMMARY OF THE INVENTION

The present invention provides a method of recovering shale oil and magnesium values from particles of subterranean formation containing oil shale and magnesium values. Such particles are retorted for decomposing kerogen in oil shale in the particles to produce gaseous and liquid products including shale oil and carbonaceous residue, and such retorted particles are heated, for example by combusting carbonaceous residue, at temperatures sufficient for converting magnesium contained therein values to more leachable form, such as magnesium oxide. Magnesium values are selectively leached from the retorted, heated particles with an acidic, aqueous leaching agent, notably an aqueous solution of a purgeable, acid-forming gas, such as carbon dioxide or sulfur dioxide.

In an embodiment of the invention, a fragmented permeable mass of formation particles containing oil shale and magnesium values is formed in an in situ oil shale retort in such a subterranean formation. A combustion zone is advanced through the fragmented mass for decomposing kerogen in oil shale in a retorting zone on the advancing side of the combustion zone to produce gaseous and liquid products including shale oil and for converting at least a portion of the magnesium values in the fragmented mass to more leachable form.

Temperatures in the combustion zone are in a range that provides good recoverability of magnesium values. Excessively low or high temperatures are detrimental to recovery of magnesium values. Temperatures in the combustion zone are at least sufficient for converting magnesium values to a form that is more leachable with solutions of purgeable, acid-forming gas than that of magnesium values in the raw oil shale e.g., at least about 600° C. Maximum temperatures in the combustion zone are below temperature at which substantial quantities of the leachable magnesium values in the retorted, combusted oil shale are further converted to less leachable form. At excessively high temperatures, magnesium values are converted to silicate mineral forms that are less leachable with a contemplated acidic aqueous leaching agent. The maximum temperature in the combustion zone is thus desirably below about 900° C.

Leaching of magnesium values from retorted, combusted oil shale in an in situ oil shale retort inherently involves relatively low liquid to solid weight ratios, on the order of about 1 to 1 or 2 to 1. The particles in the retort are relatively large, the greater weight proportion of particles having diameters above about 2 inches. However, the particles are permeable due to decomposition of kerogen and inorganic carbonates in the particles during retorting and combustion. Thus, efficient leaching of magnesium values from the particles depends upon penetration of leaching agent into the interior of the particles. It has been noted that when retorted, combusted oil shale is leached with an aqueous solution of carbon dioxide at the low liquid to solid ratios inherent in leaching in an in situ oil shale retort, a barrier can form on or near the surfaces of the particles during leaching. This barrier can interfere with further leaching by decreasing the permeability of the particles, and it arises by deposition or growth of insoluble mineral crystals, notably calcium mineral crystals, on or near the surfaces of the particles during leaching. In accordance with a preferred embodiment of this invention, it has been found that formation during leaching of such a barrier to further leaching can be reduced or substantially avoided by controlling the retorting and combusting of the oil shale. Specifically, the formation of such a barrier can be reduced or substantially avoided by controlling the maximum temperature in the combustion zone below temperatures which promote the formation of a mineral crystal barrier on the particles of retorted, combusted oil shale during leaching.

It is believed that the conversion of carbonates of calcium to oxide of calcium during retorting and combustion promotes the formation of such a barrier during leaching. Thus, it is preferred to control the maximum temperature in the combustion zone below temperatures at which undesirable quantities of calcium oxide are formed. This temperature depends in part upon the particle sizes in the fragmented mass and upon the rate of advancement of the combustion zone, which determines the time to which the particles are heated to the maximum temperature. For in situ oil shale retorts formed and operated as described herein, the maximum temperature in the combustion zone is preferably below about 800° C., more preferably below about 730° C.

After advancement of the combustion zone through the fragmented mass, magnesium values are selectively leached from combusted particles in the fragmented mass with an acidic, aqueous leaching agent, notably an aqueous solution of carbon dioxide, for forming an enriched solution containing magnesium values. Such enriched solution is withdrawn from the fragmented mass and magnesium values are recovered therefrom.

DRAWINGS

FIG. 2 shows a placement of pipes at the base of a retort of FIG. 1 for withdrawing off gas during retorting and introducing carbon dioxide containing gas during leaching.

FIG. 3 shows a presently preferred form of in situ oil shale retort undergoing leaching;

Figure 4:
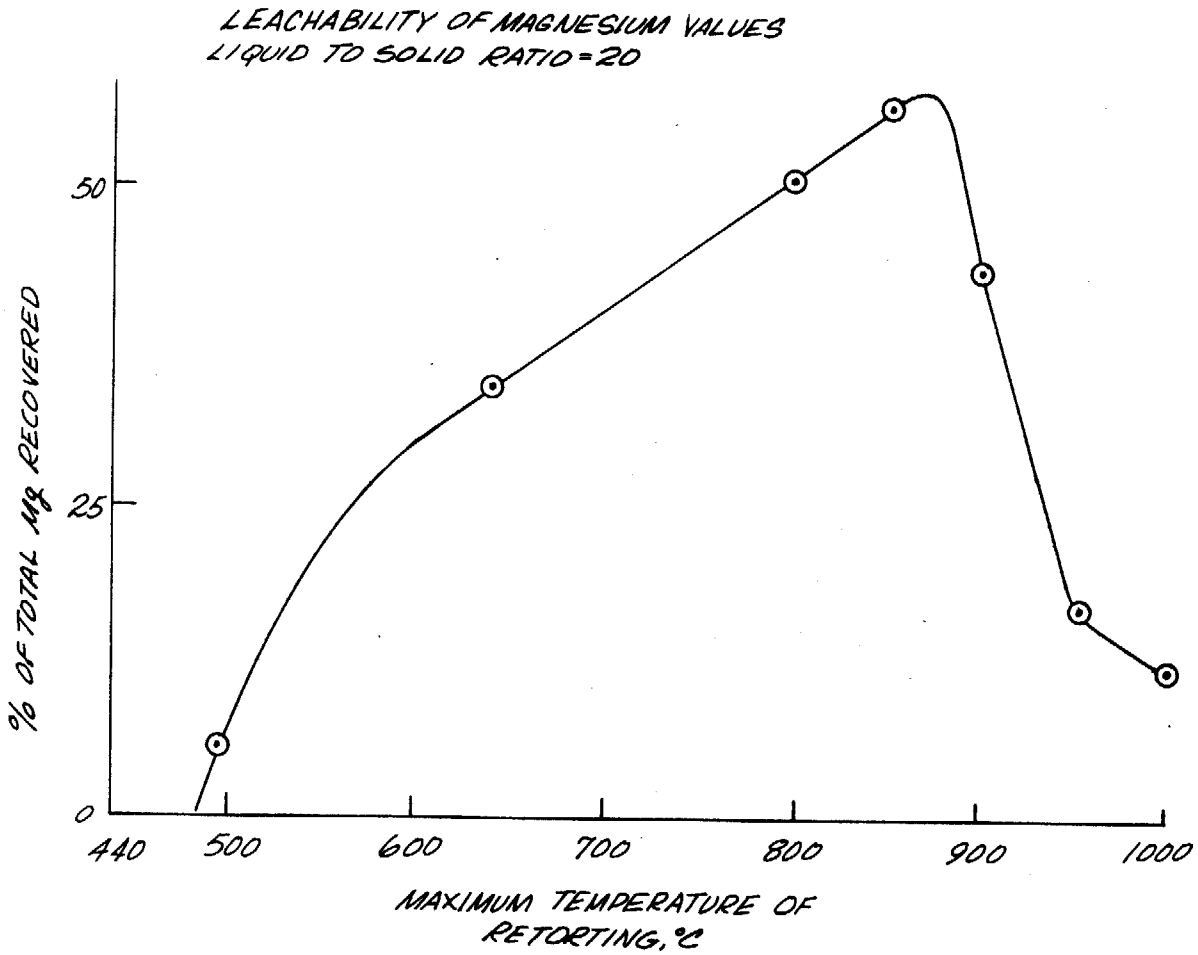
Figure 5:
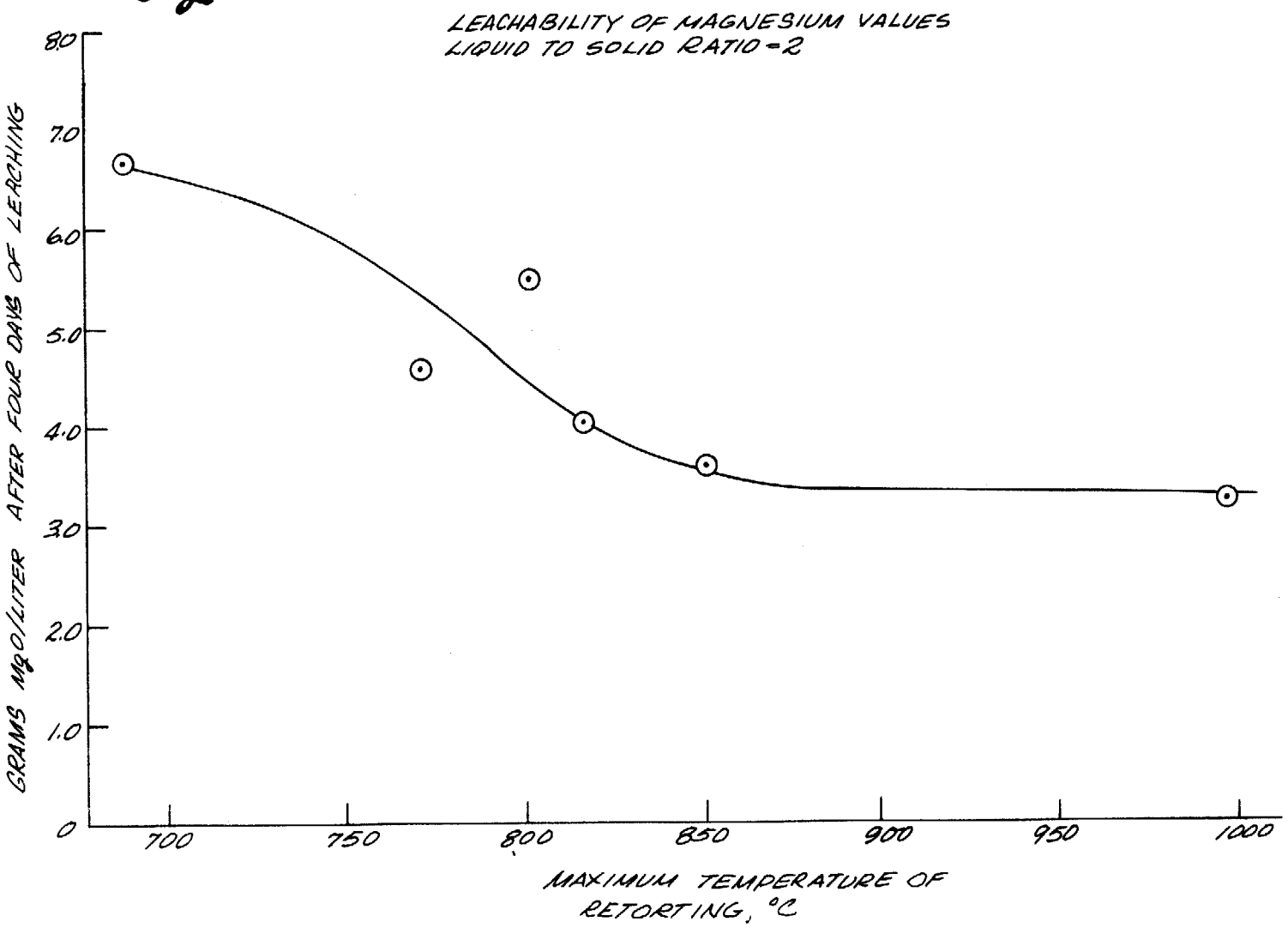

FIG. 4 graphically shows the leachability of magnesium values at a high liquid to solid ratio from combusted oil shale as a function of the maximum temperature of the shale during combustion; the high liquid to solid ratio representing those encountered in aboveground leaching of slurries in tanks; and FIG. 5 graphically shows the leachability of magnesium values at a low liquid to solid ratio from combusted oil shale as a function of the maximum temperature of the shale during combustion, the low liquid to solid ratio representing the ratios encountered in leaching in an in situ oil shale retort.

INTRODUCTION

Description

The process of this invention can be practiced in two or three distinct but interrelated phases. In the first phase, a combustion zone is advanced through a fragmented permeable mass of formation particles containing oil shale and magnesium values in an in situ oil shale retort in a subterranean formation containing oil shale and such magnesium values, notably in the form of carbonates of magnesium, whereby kerogen in oil shale in a retorting zone on the advancing side of the combustion zone is decomposed to produce gaseous and liquid products including shale oil, and particles containing retorted oil shale are combusted in the combustion zone. Particles combusted at maximum temperatures in the range of about 600° C. to 900° C. contain magnesium values in a form, e.g. magnesium oxide, that is readily leachable with an aqueous solution of carbon dioxide. Combusted particles can also contain other oxides, notably calcium oxide.

In the second phase, which is optional, combusted particles in the fragmented mass are preconditioned for leaching. Preconditioning can involve contacting combusted particles in the fragmented mass with water or water vapor for hydrating magnesium values. Preconditioning can involve contacting combusted particles in the fragmented mass with gaseous carbon dioxide for precarbonating oxides in the particles to the carbonate form. Leaching is preferably conducted at elevated partial pressures of carbon dioxide and the cost of compressing carbon dioxide or carbon dioxide containing gas to such pressures can be great. On the other hand, precarbonation can be done at ambient pressure, thereby reducing pumping costs, and precarbonation reduces the consumption of carbon dioxide during leaching, thereby reducing the quantity of carbon dioxide or carbon dioxide containing gas that must be compressed to elevated leaching pressures.

In the third phase, magnesium values are leached from combusted particles in the fragmented mass with carbonated water. At least a portion of the fragmented mass is contacted with aqueous medium, and carbon dioxide containing gas, such as off gas from an active in situ oil shale retort, is introduced into the portion of the fragmented mass in contact with the aqueous medium. Conditions of temperature and pressure which favor high concentrations of dissolved carbon dioxide in the aqueous medium are preferred. Magnesium values are leached from combusted particles to form an enriched solution containing dissolved magnesium values and dissolved carbon dioxide. Such enriched solution is withdrawn from the retort and magnesium carbonate is recovered. Recovered magnesium carbonate can be processed in accordance with known methods for conversion to magnesia (MgO).

Inasmuch as the operation of an in situ oil shale retort has been described in the patent literature, for example in said U.S. Pat. No. 4,036,299, the leaching phase of the method of the present invention will first be discussed in detail.

LEACHING PHASE

Figure 1:
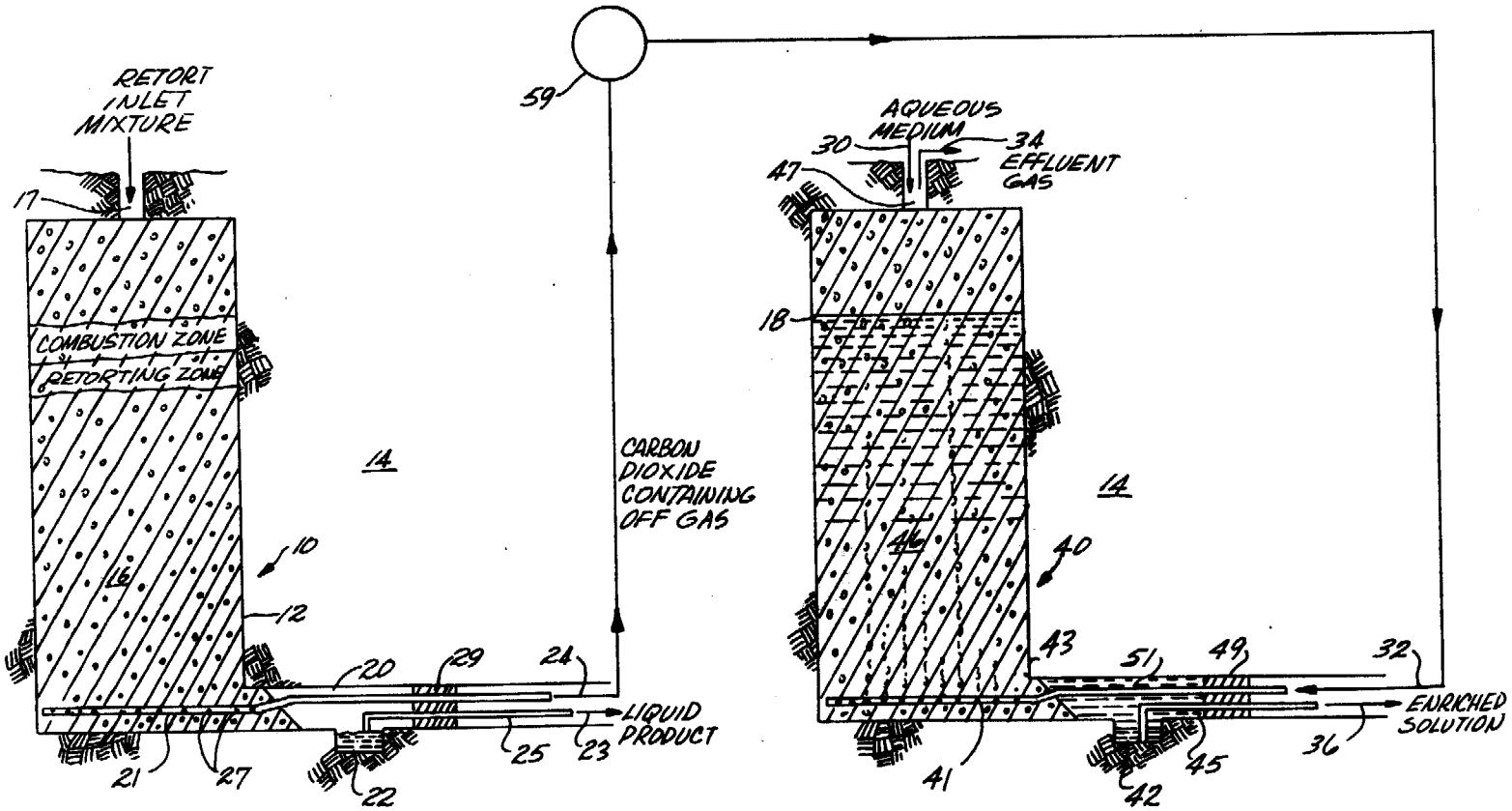
FIG. 1 illustrates in schematic cross section an active in situ oil shale retort undergoing retorting and a spent retort undergoing leaching, off gas from the active retort being introduced to the spent retort for supplying carbon dioxide for leaching.

In practice of this invention, a fragmented permeable mass of formation particles containing oil shale in an in situ oil shale retort is formed in a subterranean formation containing oil shale. Referring briefly to FIG. 1, a combustion zone is advanced through the fragmented mass 16 in the retort 10 by introduction of an inlet mixture through conduit 17 and withdrawing an off gas through the drift 20 by means of pipes 21. Kerogen in oil shale in a retorting zone on the advancing side of the combustion zone is decomposed to produce gaseous and liquid products which are withdrawn through the drift 20, and retorted particles containing residual carbon. Residual carbon supports combustion in the combustion zone. Inorganic carbonates including carbonate of magnesium and calcium in the particles are decomposed to oxide of magnesium and calcium.

After advancement of the combustion zone through the fragmented mass, the fragmented mass contains magnesium values in forms such as the oxide and the hydroxide which are readily leachable from the fragmented mass with carbonated water. The fragmented mass can be cooled and preconditioned before leaching, for example by precarbonating oxides to an active, leachable carbonate form. After retorting, cooling, and preconditioning, if any, the fragmented mass of particles containing combusted oil shale is contacted with an aqueous solution containing dissolved carbon dioxide for selectively leaching magnesium values from the particles.

In practice of this invention, magnesium values are selectively leached from the cooled fragmented mass by contacting particles in the mass with an aqueous solution containing a purgeable, acid-forming gas such as dissolved carbon dioxide or sulfur dioxide. It is believed that the aqueous carbon dioxide carbonates and dissolves leachable magnesium values. A mechanism for leaching of magnesium oxide, for example, can proceed in accordance with the chemical equations:

$$MgO + xH_2O + CO_2 \quad MgCO_3(H_2O)_x, \text{ and} \tag{1}$$

$$MgCO_3(H_2O)x + CO_2 \quad Mg(HCO_3)_2 + (x-1)H_2O \tag{2}$$

or directly, for example, in accordance with the chemical equation $$MgO + H_2O + 2CO_2 \quad Mg(HCO_3)_2. \tag{3}$$

In either case, the $Mg(HCO_3)_2$ is believed to exist only in aqueous solution containing dissolved carbon dioxide.

When carbon dioxide is in solution in water, it forms an acidic solution known as carbonic acid. The solution can contain solvated hydrogen ions and solvated bicarbonate ions. It is believed that magnesium bicarbonate can be present in such a solution in equilibrium with bicarbonate ion. When carbon dioxide is removed from such a solution, the concentration of bicarbonate ion drops and magnesium bicarbonate dissociates to form insoluble magnesium carbonate. Regardless of the actual mechanism and regardless of the actual species present in solution, the phrase "containing dissolved carbon dioxide" as it is used herein is intended to include all species, whether ionic or nonionic, which may be formed when gaseous carbon dioxide is dissolved in an aqueous medium. Similarly, the phrase "containing dissolved magnesium bicarbonate" is intended to include any dissolved form of magnesium in an aqueous solution containing dissolved carbon dioxide which precipitates as magnesium carbonate when carbon dioxide is removed from the solution.

When an aqueous solution of carbon dioxide is contacted with retorted, combusted oil shale containing alkaline earth metal oxides such as oxides of magnesium and calcium, the solution becomes enriched with magnesium values, and the pH of the solution increases and can become slightly alkaline because of the buffering action of dissolved magnesium bicarbonate. During leaching, the pH of the leaching agent can thus be slightly over 7, for example, about 7.2, even when dissolved carbon dioxide is present in the leaching agent. Such a slightly alkaline leaching solution is intended to be included within the meaning of the term "acidic, aqueous leaching agent" as the term is used herein because the dissolved carbon dioxide continues to act as an acid in acid-base reaction with the leachable magnesium values in the oil shale.

Conditions that favor increased concentration of dissolved carbon dioxide or species resulting therefrom in the leaching solution also favor leaching of magnesium values and increased concentration of magnesium values in solution. Briefly, such conditions include low temperature and high pressure, as discussed in greater detail below.

Particles containing combusted oil shale in the cooled fragmented mass are contacted with an aqueous solution of carbon dioxide at temperatures above the freezing point of the solution, preferably in the range of between about 10° C. and 60° C. Such temperatures are preferred for obtaining sufficient concentrations of magnesium values and carbon dioxide in solution for economical recovery. At temperatures substantially above 60° C., the solubility of carbon dioxide and of magnesium values is low. Solution temperatures below about 10° C. in the retort can be difficult to maintain because the leaching is exothermic and the temperature of the leaching solution tends to rise during leaching.

The effective partial pressure of carbon dioxide in at least a portion of the fragmented mass in contact with aqueous leaching agent is preferably at least about one-half atmosphere, preferably at least about one atmosphere, to provide sufficient dissolved carbon dioxide in the leaching agent. The solubility of the gas increases with increased partial pressure of the gas. The effective partial pressure is the actual partial pressure of carbon dioxide in a gaseous phase in contact with aqueous leaching agent containing dissolved carbon dioxide in the fragmented mass or the partial pressure of carbon dioxide in a gas phase which would be in equilibrium when in contact with such aqueous leaching agent containing dissolved carbon dioxide. Effective partial pressures of carbon dioxide below about one-half atmosphere can result in a low recovery of magnesium values because of the low concentration of magnesium values in the enriched solution withdrawn from the retort.

For economy, the conduit means 17 used for introducing an inlet mixture to the retort 10 during the retorting operation can be used for introducing carbon dioxide containing gas to the retort or for withdrawing effluent gas from the retort. Similarly, the pipe or pipes 21 or other means used for withdrawing off gas from the retort during the retorting operation can be used for introducing carbon dioxide containing gas to the retort or for withdrawing effluent gas from the retort.

Trickle leaching or flood leaching can be used for contacting particles in the cooled fragmented mass with the aqueous solution of carbon dioxide. In trickle leaching, particles in the fragmented mass are wetted with leaching agent that flows downwardly through the mass, but the void spaces between particles in the mass are largely occupied by gas. In flood leaching, the void spaces are largely occupied by liquid leaching agent, and the leaching agent can flow upwardly, downwardly, or laterally through the fragmented mass.

With either trickle leaching or flood leaching, aqueous solution of carbon dioxide can be formed outside of the retort and can then be introduced to the fragmented mass in the retort. Carbon dioxide can be dissolved in aqueous medium, such as water or an aqueous recycle stream from leaching operations, at ambient pressure or higher pressures and the resultant aqueous solution of carbon dioxide can be introduced into the retort at ambient or higher pressures. Because the solubility of a gas in a liquid is higher at lower temperatures, the solution of carbon dioxide is preferably prepared at leaching temperatures or lower, for example, at temperatures in the range of about 10° to 60° C. or lower, and preferably at pressures at least as high as the highest pressure in the retort during leaching. The carbon dioxide can be commercial carbon dioxide, e.g. from cylinders or solid carbon dioxide, or carbon dioxide in off gas, burned off gas, tail gas from combustion of fuel, or kiln gas obtained in the calcining of magnesium carbonate to produce magnesia, as described below. Mixtures of such gases can be used.

Carbon dioxide can be extracted or concentrated from carbon dioxide containing gas such as off gas, tail gas, or kiln gas, for example, by cooling the gas for forming liquid or solid carbon dioxide, or by extracting carbon dioxide with an organic extractant such as diethanolamine. Such extracted carbon dioxide can be dissolved in aqueous medium for introduction to the fragmented mass or it can be introduced to the fragmented mass as gaseous carbon dioxide.

Off gas from an in situ oil shale retort can contain combustible gases. Such off gas can be burned efficiently at elevated pressure, e.g., 200 psi, in a gas turbine for generating power. Exhaust gases from such a turbine can be at sufficiently high pressure to permit extraction of carbon dioxide therefrom with little additional consumption of energy.

Alternatively, or in addition, water or other aqueous medium and carbon dioxide containing gas can be introduced separately to the fragmented mass and the aqueous solution of carbon dioxide can be formed in situ in the retort.

Dissolved carbon dioxide can be consumed rapidly from solution, especially in the early stages of leaching. To obtain a satisfactory concentration of magnesium values in an enriched solution for withdrawal from the fragmented mass, and to avoid reprecipitation of dissolved values in the fragmented mass owing to depletion of the dissolved carbon dioxide, carbon dioxide containing gas is introduced to the fragmented mass during leaching.

The carbon dioxide containing gas is introduced at a sufficient rate maintain the concentration of dissolved carbon dioxide at a desired level in the enriched solution withdrawn from the fragmented mass and to avoid any appreciable reprecipitation of dissolved magnesium values within the fragmented mass.

In trickle leaching, the carbon dioxide containing gas can be introduced at the top or the bottom of the fragmented mass for cocurrent flow with the liquid aqueous leaching agent or countercurrent flow to the liquid aqueous leaching agent. In flood leaching, carbon dioxide containing gas is preferably introduced at the bottom of the fragmented mass and allowed to bubble upwardly through the fragmented mass cocurrently with or, preferably, countercurrently to the flow of liquid aqueous leaching agent. Downward flow of leaching agent is preferred in flood leaching so that as downwardly flowing solution becomes enriched with magnesium values, it encounters increasing hydrostatic pressures and increasing effective partial pressures of carbon dioxide.

In an embodiment of the present invention, the cooled fragmented mass in an in situ oil shale retort is substantially flooded with downwardly flowing aqueous medium, and carbon dioxide containing gas is introduced near the bottom of the fragmented mass. An enriched solution containing magnesium values is withdrawn from the fragmented mass at the bottom of the retort. Referring again to FIG. 1, aqueous medium 30 is introduced to a fragmented mass of particles 46 containing combusted oil shale in an in situ oil shale retort 40 through conduit means 47 and substantially floods at least a portion of the fragmented mass, for example, the portion of the fragmented mass below a liquid level indicated at line 18. The sealing means 49 in the lower drift 51 holds the liquid in the retort. Alternatively, or in addition, the drift 51 can be flooded to at least partially balance the hydrostatic head of liquid in the retort 40. The introduced aqueous medium may or may not contain dissolved carbon dioxide when introduced; preferably, it does. The introduced aqueous medium 30 flows downwardly through the fragmented mass 46 and contacts particles therein. Carbon dioxide containing off gas 24 is withdrawn from the active retort 10, is compressed in compressor 59, is introduced through line 32 and gas introduction means 41 to the fragmented mass 46, and flows upwardly through the mass. Carbon dioxide from the gas dissolves in the aqueous medium and reacts with leachable magnesium values in the fragmented mass. Continued introduction of carbon dioxide containing gas replenishes the concentration of dissolved carbon dioxide in the aqueous medium for dissolving magnesium values and holding dissolved magnesium values in solution.

As introduced aqueous medium flows downwardly, it experiences increasing pressures owing to the hydrostatic head of liquid in the retort, and also increasing effective partial pressures of carbon dioxide. Thus, the concentration of dissolved carbon dioxide in the aqueous medium tends to increase as the aqueous medium flows downwardly through the fragmented mass and the concentration of magnesium values in the aqueous medium also increases. Additionally, the increasing dissolved carbon dioxide concentration in the aqueous medium helps to prevent localized depletion of dissolved carbon dioxide and consequent reprecipitation of dissolved values. The carbon dioxide containing gas is preferably dispersed uniformly across the retort to provide uniform concentration of dissolved carbon dioxide in the aqueous medium. Effluent gas 34 withdrawn through withdrawing means 47 can have a lower carbon dioxide concentration than the carbon dioxide containing off gas introduced to the retort 40.

An aqueous medium flows downwardly through the fragmented mass, it becomes enriched with magnesium values, carbon dioxide, and also dissolves water soluble materials such as sodium salts and sulfates. Magnesium values are selectively dissolved with respect to calcium minerals, which to a great extent remain behind as insoluble calcium compounds such as calcium carbonate; substantially insoluble silicates, which are present in the raw shale or are formed during retorting; and other minerals, such as aluminum compounds, that are relatively insoluble in carbonated water.

Pressure at the bottom of the retort can be high owing to the hydrostatic head of liquid in the retort. In flood leaching, pressures as high as 10 to 15 atmospheres above ambient or higher can be encountered at the bottom of the retort, depending upon the height of the column of liquid in the retort. The effective partial pressure of carbon dioxide can be as high as the total pressure, when pure carbon dioxide gas is used, or lower. When a carbon dioxide containing gas, such as retort off gas, is used, the effective partial pressure of carbon dioxide depends upon the concentration of carbon dioxide in the gas. Gas containing at least about 20 volume percent, preferably at least about 30 volume percent, carbon dioxide is used to obtain adequate partial pressures of carbon dioxide. Adequate effective partial pressures of carbon dioxide provide a sufficient concentration of dissolved carbon dioxide in the enriched solution for maintaining the dissolved magnesium values in solution. The effective partial pressure of carbon dioxide is preferably at least about one atmosphere at the bottom of the retort when flood leaching with downwardly flowing leaching agent is used, although it can be lower at higher elevations within the retort where hydrostatic pressure can be lower.

The size and distribution of sizes of particles in the fragmented mass can affect the rate of leaching and the recovery of magnesium values. The fragmented mass can have a wide distribution of particle sizes. In situ oil shale retorts formed in accordance with the disclosures of U.S. Pat. Nos. 3,661,423; 4,043,595;; 4,043,596; 4,043,597; and 4,043,598, cited above, are suitable for recovery of shale oil and magnesium values in accordance with this invention. The fragmented mass of formation particles can have the greater part of its weight, i.e., greater than 50 percent of its weight, in particles having average effective diameters above about 2 inches. For example, an in situ oil shale retort in the Piceance Creek Basin of Colorado prepared by explosive expansion of formation toward a void is thought to contain a fragmented permeable mass consisting of about 58% by weight particles having a weight average effective diameter of 2 inches, about 23% by weight particles having a weight average diameter of 8 inches, and about 19% by weight particles having a weight average diameter of 30 inches.

U.S. Pat. No. 4,043,595, assigned to the assignee of the present application and incorporated herein by this reference, describes the formation of such a retort. Magnesium values can be recovered from such a fragmented mass in accordance with the present invention.

The leaching of magnesium values with an aqueous solution of carbon dioxide as described herein is exothermic. To maintain leaching temperature within a desired range, such as 10° to 60° C., the aqueous medium can be introduced to the fragmented mass at temperatures below the desired leaching temperatures. The aqueous medium can be cooled to any temperature above its freezing point. When the aqueous medium contains dissolved substances, which depress the freezing point of the solution, it can be cooled below the freezing point of water. The temperature of the introduced aqueous medium is regulated for maintaining the temperature of the enriched solution withdrawn from the retort within the desired leaching temperature range.

Enriched solution 36 containing magnesium values is withdrawn from the bottom of the retort 40 through the drift 51. At least a portion of the enriched solution can be withdrawn through a pipe means 45 that passes through the sealing means 49 and terminates in a sump 42. The enriched solution contains dissolved magnesium bicarbonate, dissolved carbon dioxide, and minor amounts of dissolved impurities. When the enriched solution is withdrawn through the sealing means 49, it is at the pressure prevailing at the bottom of the retort and contains dissolved carbon dioxide at a sufficient partial pressure to maintain the dissolved magnesium bicarbonate in solution.

FIG. 3 illustrates a form of in situ retort that is useful for production of shale oil and is particularly well adapted for trickle leaching. There is a fragmented permeable mass 52 of formation particles containing oil shale and magnesium values in an in situ oil shale retort 50 in a subterranean formation 14 containing oil shale. There are two sumps 55 at the bottom of the retort filled with formation particles. Drifts 57 connect the sumps to a central drift (not shown) which can be connected with other such retorts. Spaced above the retort 50 are four drifts 60 in fluid communication with the top of the fragmented mass 52 by means of a series of boreholes 70 through a horizontal sill pillar 65. The boreholes 70 are distributed along the length of each drift. For clarity, only a portion of the boreholes 70 are shown in the drawing.

During retorting, an off gas and liquid products are withdrawn from the retort through drifts 57. A combustion zone feed including an oxygen containing gas is introduced to the fragmented mass through the drifts 60 and boreholes 70, providing gas flow across the fragmented mass.

During leaching, carbon dioxide containing gas 75, such as off gas from an active in situ oil shale retort, is introduced to the retort 50 through the drifts 57. The particles in the sumps 55 tend to spread the flow of gas through the fragmented mass. Carbon dioxide containing gas flows upwardly through the fragmented mass, and an effluent gas 81 is withdrawn from the retort through at least a portion of the boreholes 70 and the drifts 60. At the same time, liquid aqueous medium 77 is introduced to the drifts 60 and flows downwardly through at least a portion of the boreholes 70. The drifts 60 and boreholes 70 are a means for introducing aqueous medium across the fragmented mass. Such introduction is beneficial both for flood leaching and for trickle leaching. Enriched solution 79 is withdrawn through the drifts 57.

Aqueous medium can be introduced through one or more of the drifts 60 and effluent gas can be withdrawn through one or more of the drifts 60. The boreholes 70 can have a sufficient diameter to permit simultaneous upward flow of gas and downward flow of liquid, so that liquid can be introduced through all four drifts and gas can be withdrawn through all four drifts. Liquid can be introduced through selected boreholes, such as alternate boreholes, by a system of pipes (not shown) and gas can be withdrawn through other boreholes. Many variations in the use of the drifts and boreholes for introduction of liquid and withdrawal of gas will be apparent.

Because the voids in the fragmented mass are largely filled with gas, the pressure in the retort is substantially uniform from top to bottom. The total pressure is at least ambient atmospheric pressure, i.e., about one atmosphere. Because partial pressures of carbon dioxide of at least about one-half atmosphere are desired for enhancing the solubility of magnesium values in the enriched solution, the carbon dioxide containing gas introduced to the retort is desirably at least about 50 volume percent carbon dioxide. Alternatively, the total pressure of gas in the retort can be raised above ambient to provide a partial pressure of carbon dioxide of at least one-half atmosphere. When pure carbon dioxide gas is used, the partial pressure of carbon dioxide equals the total pressure. When a carbon dioxide containing gas is used, the partial pressure of carbon dioxide depends upon the concentration of carbon dioxide in the gas.

The pressure of the enriched solution withdrawn from a retort undergoing flood or trickle leaching is lowered to about ambient pressure or lower for precipitating magnesium values. Dissolved carbon dioxide comes out of solution as carbon dioxide gas. As carbon dioxide comes out of solution, the solubility of the magnesium bicarbonate decreases; and hydrated magnesium carbonate precipitates from solution. The carbon dioxide can be recovered and reused for precarbonating ore leaching.

Because carbon dioxide readily comes out of aqueous solution when the pressure is lowered or the temperature is raised, it is referred to herein as a "purgeable acid-forming gas," indicating that the carbon dioxide can be purged from the enriched solution withdrawn from the retort for precipitation of magnesium values. Sulfur dioxide is another example of a purgeable acid-forming gas that can be used for selectively leaching magnesium values from an in situ oil shale retort in accordance with this invention.

The precipitation of magnesium carbonate can be accomplished in a variety of ways. Enriched solution withdrawn from the retort can be introduced to a settling pond or tank where carbon dioxide passes into the atmosphere and magnesium carbonate precipitates. Enriched solution can be sprayed over the pond or otherwise aerated to speed the removal of carbon dioxide. The temperature of the solution can be raised to lower the solubility of carbon dioxide. Techniques for precipitating magnesium carbonate from aqueous solutions of carbon dioxide and magnesium bicarbonate are described in the above mentioned Bureau of Mines Technical Paper 684.

When sufficient carbon dioxide has been removed, a slurry of precipitated hydrated magnesium carbonate in a barren solution is obtained. The barren aqueous solution can contain as little as 0.1 percent magnesium values calculated as MgO. As much as 95 percent of the magnesium values in the enriched solution can be precipitated.

Precipitated magnesium carbonate is filtered from the barren solution, dried, and calcined in kilns to magnesia as described in aforementioned Bureau of Mines Technical Paper 684. Barren solution can be recycled to the same retort or a different retort for further leaching of magnesium values.

Heat for warming enriched solution for precipitating magnesium carbonate can be obtained from a number of sources. Off gas from an operating in situ oil shale retort can have a temperature of up to about 50° C. or more and can contain substantial quantities of water vapor. Such off gas can be used to heat enriched solution, either by direct contact with the solution or by indirect contact through a heat exchanger. Off gas that is passed through enriched solution at ambient pressures or lower and ambient temperature or higher can remove carbon dioxide from the solution. Such carbon dioxide enriched off gas is useful for the precarbonation or leaching in accordance with this invention. Heat can be obtained from a hot, spent retort by passing a gas through such a retort.

When wet, precipitated basic magnesium carbonate is calcined, the resultant hot kiln gas contains steam and carbon dioxide. Such kiln gas can be used as a source of heat for removing carbon dioxide from enriched solution, and as carbon dioxide containing gas for precarbonating particles in a retorted retort and for leaching magnesium values therefrom.

Because control of maximum temperature in the combustion zone advancing through a retort during retorting is important for obtaining good results during a subsequent leaching operation, the retorting phase is described in detail below.

RETORTING PHASE

Referring again to FIG. 1, an in situ oil shale retort 10 is in the form of a cavity 12 formed in a subterranean formation 14 containing oil shale. The cavity contains a fragmented permeable mass 16 of formation particles containing oil shale. The cavity 12 can be created simultaneously with fragmentation of the mass of formation particles by blasting by any of a variety of techniques. A desirable technique involves excavating or mining a void within the boundaries of an in situ oil shale retort site to be formed in the subterranean formation and explosively expanding remaining oil shale in the formation toward such a void. Methods of forming an in situ oil shale retort are described in U.S. Pat. Nos. 3,661,423; 4,043,595; 4,043,596; 4,043,597; and 4,043,598. A variety of other techniques can also be used.

The fragmented permeable mass in the retort can have a void fraction of from about 10 to about 30 volume percent. By void fraction there is meant the ratio of the volume of voids or spaces between particles in the fragmented mass to the total volume of the fragmented permeable mass of particles in the retort.

A conduit means 17 communicates with the top of the fragmented mass of formation particles. A plurality of conduit means 17 can be used. During the retorting operation of the retort 10, a combustion zone is established in the retort by ignition of carbonaceous material in oil shale in the fragmented mass. The combustion zone is advanced through the fragmented mass by introducing an oxygen containing retort inlet mixture into the in situ oil shale retort through the conduit 17 as a combustion zone feed. The retort inlet mixture can be an oxygen supplying gas such as oxygen or air, or air enriched with oxygen, or oxygen or air diluted by a fluid such as water, steam, a fuel, recycled off gas, an inert gas such as nitrogen, and combinations thereof. Oxygen introduced to the retort in the retort inlet mixture oxidizes carbonaceous material in the oil shale to produce combustion gas. The combustion processing zone is the portion of the retort where the greater part of the oxygen in the combustion zone feed that reacts with carbonaceous residue in retorted oil shale is consumed. Heat from the exothermic oxidation reactions and oxygen carried by flowing gases can advance the combustion zone through the fragmented mass of particles.

Combustion gas produced in the combustion zone and any unreacted portion of the combustion zone feed pass through the fragmented mass of particles on the advancing side of the combustion zone to establish a retorting zone on the advancing side of the combustion zone. Kerogen in the oil shale is retorted in the retorting zone to produce liquid products including shale oil, and gaseous products including combustible gaseous products.

Formation 14 containing oil shale contains large quantities of alkaline earth metal carbonates, principally carbonates of calcium and magnesium which during retorting and combustion are at least partly calcined to produce alkaline earth metal oxides. For example, oil shale particles in the retort 10 can contain approximately 8 to 12 weight percent calcium and 1.5 to 3 weight percent magnesium present as carbonates. Carbonate of magnesium is widely distributed in both dawsonitic and non-dawsonitic oil shales in the Piceance Creek Basin and can be a significant source of magnesia, given practical techniques for recovery of the magnesium values.

Magnesium carbonate can be present initially in the formation in a variety of mineral forms of varying composition, such as magnesite or brucite; in association with calcium carbonate as dolomite, a calcium magnesium carbonate; with iron as ferroan, an iron magnesium carbonate; and with calcium and iron as ankerite, a form of dolomite in which there is about 15 percent Fe substitution for Mg. In stoichiometric dolomite, there is one magnesium atom per calcium atom. Calcium-rich dolomites having ratios of magnesium to calcium of less than one also occur. The aforementioned mineral forms, and others including illite, dawsonite, analcime, aragonite, calcite, quartz, potassium feldspar, sodium feldspar, nahcolite, siderite, pyrite, and fluorite, have been identified by x-ray diffraction analysis. The presence of such mineral forms in oil shale has been reported in W. Rob et al., "Mineral Profile of Oil Shales in Colorado Core Hole No. 1, Piceance Creek Basin, Colorado," Energy Resources of the Piceance Creek Basin, Colorado, D. Keith Murray, Ed. Rocky Mountain Association of Geologists, Denver, Colorado, pages 91-100, (19074) and E. Cook, "Thermal Analysis of Oil Shales," Quarterly of the Colorado School of Mines, Vol. 65, pages 113-140 (1970), the disclosures of which are incorporated herein by this reference; a copy of each accompanies this patent application.

The Cook article states that dolomite in oil shale in the Green River formation, which includes the Piceance Creek Basin, is actually in the form of ankerite and therefore has a lower decomposition temperature than pure iron-free dolomite. The minerals in oil shale are present in very fine crystals in various intimate admixtures and can interact during retorting and combustion. Thus, minerals such as dolomite in oil shale are not expected to behave the same as more pure forms of the mineral. In addition, as stated in the Cook article, it is difficult to predict the temperature range or the extent of carbonate decomposition during rotorting of oil shale because carbonate decompositions are dependent in part on the partial pressure of carbon dioxide in the retort atmosphere.

Magnesium carbonate in raw oil shale is not readily leachable with carbonated water, in part because kerogen in the oil shale physically prevents contact between the magnesium carbonate and leaching agent, and in part because the magnesium containing shale is initially in a form that is relatively difficult to leach. When a combustion zone is advanced through the fragmented mass, oil shale is retorted and carbonaceous residue in the retorted oil shale supports combustion in the combustion zone. The resulting combusted oil shale is somewhat permeable.

Magnesium values that can be leached from combusted oil shale with carbonated water include magnesium oxide. Combusted oil shale particles in the fragmented mass can contain substantial quantities of calcium oxide and magnesium oxide. Smaller quantities of other oxides can also be present.

The treatment of particles in the fragmented mass after advancement of the combustion zone therethrough can result in conversion of at least a portion of the magnesium oxide to other leachable forms. Thus, contacting magnesium oxide with water or water vapor or gaseous carbon dioxide can convert magnesium oxide to other forms which are leachable with carbonated water, including magnesium hydroxide, magnesium carbonate, basic magnesium carbonate such as $MgCO_3.Mg(OH)_2.3H_2O$ and $3MgCO_3.Mg(OH)_2.3H_2O$, and hydrates such as magnesium carbonate trihydrate and magnesium carbonate pentahydrate.

There is an access tunnel adit, drift 20 or the like in communication with the bottom of the retort. The drift contains a sump 22 in which liquid products 23, including shale oil and water, are collected to be withdrawn. A network of gas withdrawal means or pipes 21 is provided at the base of the fragmented mass for withdrawal of off gas. An off gas 24 containing gaseous products, combustion gas, carbon dioxide from carbonate decomposition, and any gaseous unreacted portion of the combustion zone feed, is also withdrawn through pipe means 21 and drift 20 through a bulkhead or sealing means 29. The pipe means 21 can include perforations 27 in the sides which can be of graduated size along the length of the pipes to provide uniform gas flow across the retort, as described in U.S. Pat. No. 3,941,421, the disclosure of which is incorporated herein by this reference.

In accordance with practice of this invention, the maximum temperature of particles in the fragmented mass is controlled, during advancement of the combustion zone through the fragmented mass, in a range of temperature sufficient for converting magnesium values in the oil shale to a form that is more leachable with an aqueous solution of carbon dioxide and below a temperature at which leachable magnesium values are converted to a less leachable mineral form, for example, a maximum temperature in the range of about 600° to 900° C. The most desirable temperature within such a range for production of liquid and gaseous hydrocarbon products depends upon the particle sizes and grades of oil shale being retorted, and can vary as the combustion zone advances through different grades of oil shale. The maximum temperature can be controlled by monitoring the temperature of the combustion zone, and regulating the composition of the combustion zone feed for controlling the combustion zone temperature. The concentration of oxygen, the concentration of diluent such as steam or recycled off gas, the concentration of added fuel, and the flow rate of the combustion zone feed can all be varied for controlling the maximum temperature in the combustion zone.

The maximum temperature in the combustion zone and the rate of advancement of the combustion zone through the fragmented mass both affect the extent to which alkaline earth metal carbonates, such as carbonates of calcium and magnesium in the oil shale are calcined, i.e. decomposed to oxides. This is because the rates of the decomposition reactions are temperature dependent and can also be limited by the rate of heat transfer into the interiors of particles and the diffusion of decomposition products such as carbon dioxide out of the particles. The rate of advancement of the combustion zone is preferably sufficient to give a good rate of retorting and slow enough to provide adequate time for heating of particles for decomposing carbonates of magnesium to more leachable form. For example, in producing shale oil from an in situ oil shale retort formed and operated as described in the above-mentioned U.S. Pat. Nos. 3,661,423; 4,042,595; 4,043,596; 4,043,597; 4,043,598, the rate of advancement of the combustion zone can be at least about 0.1 foot per day, preferably in the range of from about 0.5 to 2 feet per day, as disclosed in U.S. Pat. No. 4,036,299. The maximum temperatures mentioned herein are given with reference to such rates of advancement, which are useful for in situ oil shale retorts having weight average particle sizes of several inches, e.g. about 8 inches, and average oil shale grades on the order of about 15 to 20 gallons per ton, Fischer assay.

It has been observed that when oil shale is subjected to maximum temperatures in a combustion zone much in excess of about 730° C., the leaching of magnesium values therefrom with carbonated water at the low liquid to solid ratios inherent in leaching in an in situ oil shale retort can be deleteriously affected. When particles of such shale are contacted with carbonated water at low liquid to solid ratios, e.g., about two, some magnesium values are leached, but the rate of leaching can prematurely fall off, sometimes almost to zero. It appears that a mineral crystal barrier can form during leaching on or within the particles and interfere with further leaching. Observation of particles with a scanning electron microscope has confirmed that crystal growth or scaling can occur on or near the surfaces of the particles during leaching at low liquid to solid ratios. At least a portion of such crystals appear upon visual inspection to be gypsum. Without intending to be bound by a particular theory, it is hypothesized that calcium minerals initially dissolve in the leaching agent and reach saturation, and calcium minerals of low solubility in the acidic aqueous leaching agent crystallize out of solution upon the particles being leached to form a barrier that retards or halts diffusion of leaching agent into and out of the particles.

The formation of such a barrier is especially disadvantageous when particles in an in situ retort are being leached because the weight average effective diameter of the particles is relatively large, for example, about 2 inches, and a substantial proportion of the particles can have effective diameters greater than 18 inches. Leaching of combusted oil shale in an in situ retort is effective because, among other reasons, the particles are permeable and therefore have a very high effective surface area available for leaching. A mineral crystal barrier near the outer surfaces of the particles can retard or prevent leaching agent from entering the interior of the particles. As a result, leaching can be slowed to an impractical rate or even be halted. Such an effect has been observed in laboratory leaching tests using ⅛ inch to 179 inch particles of combusted oil shale.

The liquid to solid ratio is the weight ratio of liquid leaching agent to solid particles being contacted in the retort during leaching. The ratio excludes leaching agent circulating in the other parts of the system, such as drifts and feed lines, and excludes portions of the fragmented mass not in contact with leaching agent.

Leaching conditions in an in situ oil shale retort are inherently characterized by low weight ratios of liquid to solid because the void fraction, i.e., the fraction of the total volume of the fragmented mass attributable to voids and interstices between and among the particles is on the order of about 10 to 30 volume percent. Thus, the volume of liquid that an in situ oil shale retort can hold is limited. Even though particles containing combusted oil shale have a porosity on the order of 20 to 35 percent by volume, at least a portion of which is permeable, and can absorb substantial quantities of water, the weight ratio of liquid to solid in such an in situ retort during leaching is generally less than one to one. Such ratios can be lower than about one half to one, even when the fragmented mass in the retort is substantially flooded with leaching agent. Liquid to solid ratios in in situ leaching of combusted oil shale are therefore relatively low compared with, for example, liquid to solid ratios for above-ground leaching of slurries in agitated tanks, in which the liquid to solid weight ratio can be greater than one, e.g. five to one, ten to one, or higher.

The above-mentioned deleterious effects can be alleviated or substantially avoided by controlling conditions in the retort during retorting for converting oil shale in the retort to an aqueous liquid permeable mineral form that retains its permeability during leaching, for example, by controlling the maximum temperature in the combustion zone in the range of from about 600° C to 800° C., more preferably from about 600° C. to 730° C. When the maximum temperature in the combustion zone is controlled within the range of about 600° C. to 730° C., a substantially higher recovery of magnesium values is obtained before the rate of leaching declines than is the case when maximum temperatures much above 730° C. are used, and the leaching rate appears to follow predictions based upon a diffusion controlled process. That is, the tendency of the leaching rate to decline prematurely is substantially avoided.

FIG. 4 is a graph of the recovery of magnesium values, expressed as MgO, from ¼ inch by 150 inch particles containing combusted oil shale plotted against maximum temperature in a combustion zone. The curve is derived from small scale experiments in an above-ground pilot plant retort designed to simulate the combustion of oil shale in an in situ oil shale retort.

The curve of FIG. 4 is thought to be representative of the leachability of combusted oil shale when leached at high liquid to solid ratios; such a leaching method involving a series of stirred tanks for leaching finely ground calcined dolomite, rather than oil shale, is described in the above mentioned Bureau of Mines Technical Paper 684. Leaching was with carbonated water at a high liquid to solid ratio of about twenty to one. It can be seen that the highest recovery of magnesium values occurs when the maximum temperature is about 870° C., substantially above the range of 600° to 730° C. which is preferred herein for processing oil shale that is to be leached at the low liquid to solid ratios encountered in an in situ oil shale retort.

FIG. 5 shows a plot of MgO recovery against maximum temperature in a combustion zone for ¼ inch by ⅛ inch particles containing combusted oil shale leached with carbonated water at a low liquid to solid ratio of about two to one. The particles were retorted and combusted in the same above-ground pilot plant retort used to obtain the curve of FIG. 4. The decline in recovery of MgO for maximum temperatures in the combustion zone above about 700° C., especially for maximum temperatures above about 800° C., is evident.

Maximum temperatures below about 800° C., more preferably below about 730° C., can provide preferential decomposition of carbonate of magnesium in oil shale in an in situ oil shale retort with respect to carbonate of calcium because at such temperatures carbonate of magnesium in oil shale decomposes faster than carbonate of calcium. In an in situ oil shale retort formed and operated as contemplated herein, particles can be subjected to such maximum temperatures for up to one or two days, depending upon the rate of advancement of the combustion zone. Under such conditions, controlling the maximum temperature of the combustion zone in a range below about 800° C., more preferably below about 730° C., can provide extensive decomposition of carbonate of magnesium and limited decomposition of carbonate of calcium.

It is believed, without intending to be bound by the theory, that limiting the decomposition of carbonate of calcium during retorting and combustion limits the aforesaid formation of mineral crystals on or near the surfaces of the particles during leaching. Thus, in an embodiment of the invention, conditions during retorting of an in situ oil shale retort are controlled for limiting the decomposition of carbonate of calcium in the retort, including conditions such as the maximum temperature and the rate of advancement of the combustion zone and the partial pressure of carbon dioxide in the combustion zone. Increasing the partial pressure of carbon dioxide decreases the rate of carbonate decomposition at a given temperature. Although the use of higher maximum temperatures, e.g. about 870° C., improves the leachability of magnesium values when leaching at high liquid to solid ratios as shown in FIG. 5, it promotes the formation of the described mineral crystal growth during leaching at low liquid to solid ratios. For this reason, the use of maximum combustion zone temperatures below about 800° C., more preferably below about 730° C., is preferred for retorting an in situ oil shale retort from which magnesium values are to be leached in accordance with this invention.

Other steps can be taken to prevent the formation of a mineral crystal barrier. An anti-scaling additive, for example, a polyelectrolyte such as a polyacrylate or a polyphosphonic acid can be included in the leaching agent to retard crystal growth. Such an additive can be a complexing agent for calcium that prevents or retards the growth of calcium mineral crystals on or near the surfaces of the particles during leaching. Alternatively, a minor proportion of sulfur dioxide can be included in a carbon dioxide containing gas introduced to the retort during all or part of the leaching operation.

After the combustion zone has been advanced through the fragmented mass, particles in the mass are at an elevated temperature which can be in excess of 500° C. The hottest region of a retort can be near the bottom, and a somewhat cooler region at the top due to continual cooling by gaseous feed during retorting and conduction of heat to adjacent oil shale. The combustion zone can be extinguished by interrupting the flow of oxygen-containing gas for a sufficient time to allow the hottest zone of the retort to cool to below the ignition temperature of carbonaceous residue in the mass. The oil shale in the retort gradually cools toward ambient temperature when retorting and combustion are complete. Before introduction of aqueous leaching agent, particles in the mass are cooled to temperatures at which liquid aqueous leaching agent will remain liquid at the leaching pressures employed.

PRECONDITIONING PHASE

The fragmented mass of particles containing combusted oil shale can be preconditioned in a number of ways before leaching. Such preconditioning can include cooling the fragmented mass in particular ways and treating the mass during or after cooling with water in liquid or vapor form, with carbon dioxide containing gas such as off gas from an active in situ oil shale retort, or with both.

The fragmented mass can be cooled after retorting by introducing water to the fragmented mass. The water can be introduced through conduit means 17 as a steam, a mist, or a spray, for example, and be allowed to trickle down through the fragmented mass or to flood the fragmented mass.

The fragmented mass can be cooled by flowing a gas through the mass. The gas can be flowed downwardly or upwardly through the mass. For example, off gas from another in situ oil shale retort can be flowed through the retort at the end of a retorting period in which a combustion zone has been advanced through the fragmented mass to cool the fragmented mass. A sufficient pressure differential is established between the top and the bottom of the retort to cause gas to flow through the retort in the desired direction.

In an embodiment of this invention, the cooling gas is a carbon dioxide containing gas. the carbon dioxide containing gas can be combustion gas from burning of fuel, or off gas from another in situ oil shale retort. Such off gas an contain up to 30 volume percent carbon dioxide or more, depending upon the composition of the retort inlet mixture. An inlet mixture of steam and oxygen can produce an off gas having more than 30 volume percent carbon dioxide. Such off gas can also contain combustible hydrocarbon products such as methane, and can be burned for converting at least a portion of the combustible products to carbon dioxide. Carbon dioxide in the cooling gas can react with calcium and magnesium compounds, notably oxides of calcium and magnesium in the fragmented mass during cooling to precarbonate at least a portion of such oxides, thereby reducing consumption of carbon dioxide during leaching. This can be advantageous when leaching at elevated carbon dioxide pressures because compression of carbon dioxide containing gas to the elevated pressure can be costly.

The total content of such oxides in the combusted particles and the relative proportions of magnesium oxide to calcium oxide are determined in part by the maximum temperature to which the particles are exposed in the combustion zone and the duration of such exposure. Excessively high temperatures can result in formation of large quantities of calcium oxide, even substantially complete conversion of calcium carbonates to calcium oxide. Lower maximum temperatures produce a higher ratio of magnesium oxide to calcium oxide, but substantial quantities of calcium oxide are usually formed even when maximum temperatures in the range of about 600° C. -800° C. are used. Two moles of carbon dioxide are required to convert one mole of magnesium oxide to the soluble bicarbonate form, and one mole of carbon dioxide can react with one mole of calcium oxide to produce insoluble calcium carbonate. the carbon dioxide consumed by reaction with calcium oxide is wasted in that it does not contribute to recovery of magnesium values.

It is estimated that at least about 2.5 moles of carbon dioxide will be consumed per mole of magnesium oxide recovered. As discussed in greater detail below, leaching is preferably conducted at elevated pressures on the order of 12 atmospheres gauge. It can be very costly to compress carbon dioxide containing gas to such pressures in the quantities required for dissolving magnesium oxide and reacting with calcium oxide. Therefore, it is desirable to limit the consumption of carbon dioxide at such elevated pressures.

Precarbonation of oxides in the fragmented mass before leaching can be carried out at relatively low pressure, such as ambient pressure to decrease subsequent consumption of high pressure carbon dioxide. To the extent that oxides are precarbonated with carbon dioxide containing gas at ambient pressure, the consumption of carbon dioxide at elevated leaching pressure is reduced, and the cost of compressing carbon dioxide containing gas to such elevated pressure is also reduced. Although preliminary tests suggest that precarbonation may lower the leaching rate of magnesium values somewhat, the reduced consumption of carbon dioxide during leaching of precarbonated oil shale can render the precarbonation step advantageous.

The fragmented mass can be preleached, after retorting and before leaching for magnesium values, with water or a leaching agent in which the magnesium values are substantially insoluble. Such a preleach can remove soluble salts such as salts, potassium, nitrates, sulfates, and the like from the fragmented mass to avoid contamination of the enriched solution of magnesium values obtained upon leaching with carbonated water. Preleaching may also lower the rate of subsequent leaching of magnesium values.

The following example further illustrates practice of the present invention.

EXAMPLE

The following is a description of a projected commercial scale leaching operation. All figures are projections or estimates based upon small scale testing.

Eight in situ oil shale retorts arranged in two rows of four retorts are formed. The eight retorts are connected at the bottom to a common drift between the rows of retorts, through which liquid and gaseous products are withdrawn during retorting. Each rotort is 200 feet square and310 feet high, and in addition includes a tapered section at the bottom extending downwardly 105 feet below the retort to a drift. Each retort includes a fragmented permeable mass of formation particles containing oil shale and carbonate of magnesium, the mass having a void fraction of about 25 percent. Before retorting, the total weight of formation particles in the eight retorts is about 5 million tons, of which about 4.5 weight percent is magnesium calculated as MgO. Formation particles in the fragmented masses are retorted and combusted at sufficient temperatures for converting oil shale to a form from which magnesium values can be selectively leached with an acidic aqueous leaching agent such as carbonated water, preferably at maximum temperatures in the range of about 600°-730° C. for producing gaseous products and liquid products including shale oil. After retorting and combustion have been completed, magnesium values are leached from the retorts.

During leaching, each retort is flooded and about 1250 gallons per minute of aqueous medium including water and recycled aqueous medium from a basic magnesium carbonate recovery system is introduced at about ambient temperature at the top of each retort and is passed downwardly through the fragmented mass. The pressure is about 0 pounds per square inch gauge (psig) at the top of each retort, about 134 psig at the bottom of each retort, and about 180 psig at the drift below each retort. About 11,500 standard cubic feet per minute of off gas from another cluster of retorts undergoing retorting and combustion is introduced at the bottom of each retort and is passed upwardly through the fragmented mass. The off gas contains about 30 volume percent carbon dioxide.

Enriched solution containing 131 pounds of magnesium calculated as MgO per 1000 gallons is withdrawn at the rate of about 1250 gallons per minute from each retort and is pumped to the surface for recovery of magnesium values. It is expected that about 50 percent of the magnesium, about 111,000 tons as MgO, can be recovered from the eight retorts over a period of about 120 days of leaching.

Modifications and variations of the above-described embodiments can be made without departing from the scope of the present invention. For example, a plurality of active retorts can be retorted simultaneously and a plurality of spent retorts can be leached simultaneously, with carbon dioxide containing off gas from the active retorts being introduced into the spent retorts for leaching magnesium values. For flowing liquid or gas laterally through a fragmented mass or a portion thereof, vertical shifts can be drilled into the fragmented mass near the sides of the retort, and fluid can be introduced through at least one such shaft and be withdrawn from at least one other such shaft laterally spaced from the first shaft.

The principles of the present invention can also be employed for recovering magnesium values from oil shale that has been retorted above ground for producing gaseous and liquid products including shale oil and has been heated to maximum temperatures, e.g., temperatures in the range of about 600° to 900° C., sufficient for converting magnesium values in such shale to a form that is leachable of magnesium values from carbonated water. The retorting and heating can be done in one step or in separate steps by indirect heat exchange, e.g., by contact with hot ceramic balls; by combustion of carbonaceous values in the particles; or by combinations of such methods. Such retorted heated particles are contacted with an aqueous solution containing sufficient dissolved carbon dioxide for leaching magnesium values from the particles and for forming enriched solution containing such magnesium values. Such enriched solution is separated from the particles, and magnesium values are recovered from the enriched solution.

Although the present invention has been described with reference to particular details and embodiments thereof, the particles are not intended to limit the invention, the particulars are not intended to limit the invention, the scope of which is defined in the following claims:

What is claimed is:

1. A method for recovering shale oil and leaching magnesium values from formation particles in an in situ oil shale retort in a subterranean formation containing oil shale and magnesium values which comprises:

advancing a combustion zone through a fragmented permeable mass of formation particles containing oil shale and magnesium values in an in situ oil shale retort by introducing an oxygen containing gas to the fragmented mass on the trailing side of the combustion zone and withdrawing an off gas from the fragmented mass on the advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including shale oil and carbonaceous residue, such carbonaceous residue supporting combustion in the combustion zone at sufficient temperatures for converting oil shale to a form from which magnesium values can be selectively leached;

selectively leaching magnesium values from at least a portion of the fragmented mass by contacting particles in the fragmented mass with an acidic aqueous leaching agent containing dissolved purgeable acid-forming gas for forming enriched solution containing magnesium values;

withdrawing enriched solution containing magnesium values from the retort; and recovering magnesium values from such enriched solution.

2. A method as recited in claim 1 in which the leaching agent contains sufficient dissolved carbon dioxide for forming enriched solution containing dissolved magnesium bicarbonate.

3. A method as recited in claim 2 in which particles in the fragmented mass are contacted with the leaching agent at temperatures in the range of from about 10° C. to 60° C.

4. A method as recited in claim 2 comprising the step of contacting at least a portion of the fragmented mass with aqueous liquid and introducing carbon dioxide containing gas to the portion of the fragmented mass in contact with the aqueous liquid.

5. A method as recited in claim 4 in which gaseous carbon dioxide is present in at least a portion of the fragmented mass at an effective partial pressure of at least about one atmosphere.

6. A method as recited in claim 1 comprising the step of pre-leaching at least a portion of the fragmented mass with an aqueous medium having a pH at which said magnesium values are substantially insoluble before the fragmented mass is contacted with the acidic aqueous leaching agent.

7. A method as recited in claim 1 in which calcium and magnesium oxide are formed in the fragmented mass during advancement of the combustion zone therethrough and which comprises the step of contacting at least a portion of the fragmented mass after advancement of the combustion zone therethrough with carbon dioxide containing gas for precarbonating at least a portion of the oxides in the fragmented mass.

8. A method as recited in claim 7 wherein the carbon dioxide containing gas also contains water vapor.

9. A method as recited in claim 1 in which the particles in the fragmented mass have a weight average effective diameter in the range of from about 2 to 18 inches.

10. A method as recited in claim 1 which comprises trickling the leaching agent downwardly through the fragmented mass.

11. A method as recited in claim 10 which comprises flowing carbon dioxide containing gas upwardly through the fragmented mass.

12. A method as recited in claim 1 which comprises substantially flooding at least a portion of the fragmented mass with leaching agent and flowing leaching agent downwardly through the flooded portion of the fragmented mass.

13. A method as recited in claim 12 which comprises flowing carbon dioxide containing gas upwardly through the flooded portion of the fragmented mass.

14. A method as recited in claim 1 which comprises cooling particles in the fragmented mass by introducing water into the fragmented mass before leaching with acidic aqueous leaching agent.

15. A method as recited in claim 13 which comprises the steps of providing at least one perforated pipe near the bottom of the fragmented mass for withdrawing off gas, and introducing carbon dioxide containing gas to the fragmented mass through such a pipe.

16. A method for recovering shale oil and leaching magnesium values from formation particles in an in situ oil shale retort in a subterranean formation containing oil shale and magnesium values which comprises:

advancing a combustion zone through a fragmented permeable mass of formation particles containing oil shale and magnesium values in an in situ oil shale retort by introducing an oxygen containing gas to the fragmented mass on the trailing side of the combustion zone and withdrawing an off gas from the fragmented mass on the advancing side of the combustion zone, whereby gas flowing through the combustion zone transfers heat of combustion to a retorting zone in the fragmented mass on the advancing side of the combustion zone wherein kerogen in oil shale in the retorting zone is decomposed to produce gaseous and liquid products including shale oil and carbonaceous residue, such carbonaceous residue supporting combustion in the combustion zone at sufficient temperatures for converting oil shale to a form from which magnesium values can be selectively leached;

controlling the maximum temperature of particles in the fragmented mass in the range of from about 600° C. to 800° C. during advancement of the combustion zone through the fragmented mass;

selectively leaching magnesium values from at least a portion of the fragmented mass by contacting particles in the fragmented mass with an acidic aqueous leaching agent for forming enriched solution containing magnesium values;

withdrawing enriched solution containing magnesium values from the retort; and recovering magnesium values from such enriched solution.

17. A method as recited in claim 16 which comprises controlling the maximum temperature of particles in the fragmented mass in the range of from about 600° C. to 800° C. during advancement of the combustion zone through the fragmented mass.

18. A method for recovering shale oil and leaching magnesium values from formation particles in an in situ oil shale retort in a subterranean formation containing oil shale and magnesium values which comprises:

advancing a combustion zone through a fragmented permeable mass of formation particles containing oil shale and magnesium values in an in situ oil shale retort by introducing an oxygen containing gas to the fragmented mass on the trailing side of the combustion zone and withdrawing an off gas from the fragmented mass on the advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including shale oil and carbonaceous residue, such carbonaceous residue supporting combustion in the combustion zone at sufficient temperatures for converting oil shale to a form from which magnesium values can be selectively leached;

cooling particles in the fragmented mass before leaching by introducing carbon dioxide containing gas to the fragmented mass and withdrawing gas from the fragmented mass having a lower content of carbon dioxide than the introduced gas;

selectively leaching magnesium values from at least a portion of the fragmented mass by contacting particles in the fragmented mass with an acidic aqueous leaching agent for forming enriched solution containing magnesium values;

withdrawing enriched solution containing magnesium values from the retort; and recovering magnesium values from such enriched solution.

19. A method for recovering shale oil and leaching magnesium values from formation particles in an in situ oil shale retort in a subterranean formation containing oil shale and magnesium values which comprises:

advancing a combustion zone through a fragmented permeable mass of formation particles containing oil shale and magnesium values in an in situ oil shale retort by introducing an oxygen containing gas to the fragmented mass on the trailing side of the combustion zone and withdrawing an off gas from the fragmented mass on the advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including shale oil and carbonaceous residue, such carbonaceous residue supporting combustion in the combustion zone at sufficient temperatures for converting oil shale to a form from which magnesium values can be selectively leached;

cooling particles in the fragmented mass before leaching by flowing carbon dioxide containing gas through the fragmented mass in a direction opposite to the direction of advancement of the combustion zone;

selectively leaching magnesium values from at least a portion of the fragmented mass by contacting particles in the fragmented mass with an acidic aqueous leaching agent for forming enriched solution containing magnesium values;

withdrawing enriched solution containing magnesium values from the retort; and recovering magnesium values from such enriched solution.

20. A method for recovering shale oil and leaching magnesium values from formation particles in an in situ oil shale retort in a subterranean formation containing oil shale which comprises:

advancing a combustion zone through a fragmented permeable mass of formation particles containing oil shale and magnesium values in an in situ oil shale retort by introducing an oxygen-containing gas to the fragmented mass on a trailing side of the combustion zone and withdrawing an off gas from the fragmented mass on an advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including shale oil and carbonaceous residue, said carbonaceous residue supporting combustion in the combustion zone;

controlling the maximum temperature of particles in the fragmented mass in the range of about 600° C. to 800° C. during advancement of the combustion zone through the fragmented mass;

cooling the fragmented mass after advancement of the combustion zone therethrough;

contacting at least a portion of the cooled fragmented mass with an aqueous leaching agent containing sufficient dissolved carbon dioxide for forming enriched solution containing magnesium values;

withdrawing enriched solution containing magnesium values from the fragmented mass; and recovering magnesium values from such enriched solution.

21. A method as recited in claim 20 in which particles in the fragmented mass are contacted with the leaching agent at temperatures in the range of from about 10° C. to 60° C.

22. A method as recited in claim 20 in which calcium and magnesium oxides are formed in the fragmented mass during advancement of the combustion zone therethrough and which comprises the step of contacting at least a portion of the fragmented mass after advancement of the combustion zone therethrough and before leaching with a gas comprising sufficient carbon dioxide for reacting with at least a portion of the oxides formed in the fragmented mass.

23. A method as recited in claim 20 comprising the step of contacting at least a portion of the fragmented mass with aqueous liquid and introducing carbon dioxide containing gas to the portion of the fragmented mass in contact with the aqueous liquid.

24. A method as recited in claim 23 in which gaseous carbon dioxide is present in at least a portion of the fragmented mass at an effective partial pressure of at least about one atmosphere.

25. A method as recited in claim 23 which comprises substantially flooding at least a portion of the fragmented mass with leaching agent, flowing leaching agent downwardly through the flooded portion, and flowing carbon dioxide containing gas upwardly through the fragmented mass.

26. A method as recited in claim 20 which comprises controlling the maximum temperature of particles in the fragmented mass in the range of from about 600° C. to 730° C. during advancement of the combustion zone through the fragmented mass.

27. A method for recovering shale oil and leaching magnesium values from formation particles in an in situ oil shale retort in a subterranean formation containing oil shale which comprises:

advancing a combustion zone through a fragmented permeable mass of formation particles containing oil shale and carbonate of magnesium in an in situ oil shale retort by introducing an oxygen-containing gas into the fragmented mass on a trailing side of the combustion zone and withdrawing an off gas from the fragmented mass on an advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including shale oil and carbonaceous residue, said carbonaceous residue supporting combustion in the combustion zone at sufficient temperatures for converting at least a portion of the carbonate of magnesium ion the fragmented mass to magnesium oxide;

cooling the fragmented mass after advancement of the combustion zone therethrough;

contacting at least a portion of the cooled fragmented mass with an acidic aqueous leaching agent containing sufficient dissolved carbon dioxide for forming enriched solution containing dissolved magnesium bicarbonate;

withdrawing enriched solution containing dissolved magnesium bicarbonate from the fragmented mass; and recovering basic magnesium carbonate from such enriched solution.

28. A method as recited in claim 27 which comprises controlling the maximum temperature of particles in the fragmented mass in the range of from about 600° C. to 800° C. during advancement of the combustion zone through the fragmented mass.

29. A method as recited in claim 27 which comprises controlling the maximum temperature of particles in the fragmented mass in the range of from about 600° C. to 730° C. during advancement of the combustion zone through the fragmented mass.

30. A method as recited in claim 27 in which particles in the fragmented mass are contacted with the leaching agent at temperatures in the range of from about 10° C. to 60° C.

31. A method as recited in claim 27 comprising the step of contacting at least a portion of the fragmented mass with aqueous liquid and introducing carbon dioxide containing gas to the portion of the fragmented mass in contact with the aqueous liquid.

32. A method as recited in claim 31 in which gaseous carbon dioxide is present in at least a portion of the fragmented mass at an effective partial pressure of at least about one atmosphere.

33. A method as recited in claim 31 which comprises substantially flooding at least a portion of the fragmented mass with aqueous liquid, flowing aqueous liquid downwardly through the flooded portion of the fragmented mass, and flowing carbon dioxide containing gas upwardly through the flooded portion of the fragmented mass.

34. A method for recovering shale oil and leaching magnesium values from formation particles in an in situ oil shale retort in a subterranean formation containing oil shale which comprises:

advancing a combustion zone through a fragmented permeable mass of formation particles containing oil shale and magnesium values in an in situ oil shale retort by introducing an oxygen-containing gas to the fragmented mass on a trailing side of the combustion zone and withdrawing an off gas from the fragmented mass on an advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products and carbonaceous residue, said carbonaceous residue supporting combustion in the combustion zone at sufficient temperatures for converting at least a portion of the oil shale in the fragmented mass to a form from which magnesium values can be leached, particles in the fragmented mass after advancement of the combustion zone therethrough containing combusted oil shale;

cooling the fragmented mass after advancement of the combustion zone therethrough;

contacting at least a portion of the combusted oil shale in the cooled fragmented mass with an aqueous leaching agent containing sufficient dissolved carbon dioxide and introducing carbon dioxide containing gas at a partial pressure of carbon dioxide of at least about one atmosphere to the portion of the fragmented mass in contact with the leaching agent for forming an enriched solution containing dissolved magnesium bicarbonate;

withdrawing enriched solution containing dissolved magnesium bicarbonate from the fragmented mass; and recovering basic magnesium carbonate from such enriched solution.

35. A method as recited in claim 34 which comprises controlling the maximum temperature of particles in the fragmented mass in the range of from about 600° C. to 800° C. during advancement of the combustion zone through the fragmented mass.

36. A method as recited in claim 34 which comprises controlling the maximum temperature of particles in the fragmented mass in the range of from about 600° C. to 730° C. during advancement of the combustion zone through the fragmented mass.

37. A method as recited in claim 34 in which combusted oil shale in the fragmented mass is contacted with the leaching agent at temperatures in the range of from about 10° C. to 60° C.

38. A method as recited in claim 34 which comprises substantially flooding at least a portion of the fragmented mass with such leaching agent, flowing such leaching agent downwardly through the flooded portion of the fragmented mass, and flowing carbon dioxide containing gas upwardly through the flooded portion of the fragmented mass.

39. A method for recovering shale oil and leaching magnesium values from formation particles in an in situ oil shale retort in a subterranean formation containing oil shale which comprises:

advancing a combustion zone through a fragmented permeable mass of formation particles containing oil shale and carbonate of magnesium in an in situ oil shale retort by introducing an oxygen-containing gas into the fragmented mass on a trailing side of the combustion zone and withdrawing an off gas from the fragmented mass on an advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including shale oil and carbonaceous residue, said carbonaceous residue supporting combustion in the combustion zone at sufficient temperatures for calcining at least a portion of the carbonate of magnesium in the fragmented mass to magnesium oxide;

cooling the fragmented mass after advancement of the combustion zone therethrough;

flooding at least a portion of the cooled fragmented mass with aqueous leaching agent containing sufficient dissolved carbon dioxide for dissolving magnesium oxide and forming enriched solution containing dissolved carbon dioxide and magnesium values;

withdrawing enriched solution containing magnesium values from the fragmented mass; and recovering magnesium values from such enriched solution.

40. A method as recited in claim 39 which comprises controlling the maximum temperature of particles in the fragmented mass in the range of from about 600° C. to 800° C. during advancement of the combustion zone through the fragmented mass.

41. A method as recited in claim 39 which comprises controlling the maximum temperature of particles in the fragmented mass in the range of from about 600° C. to 730° C. during advancement of the combustion zone through the fragmented mass.

42. A method as recited in claim 39 in which particles in the fragmented mass are contacted with the leaching agent at temperatures in the range of from about 10° C. to 60° C.

43. A method as recited in claim 39 which comprises flowing such leaching agent downwardly through the flooded portion of the fragmented mass and flowing carbon dioxide containing gas upwardly through the flooded portion of the fragmented mass.

44. A method as recited in claim 43 in which gaseous carbon dioxide is present in at least a portion of the fragmented mass at an effective partial pressure of at least about one atmosphere.

45. A method for recovering shale oil and leaching magnesium values from formation particles in an in situ oil shale retort in a subterranean formation containing oil shale which comprises:

advancing a combustion zone through a fragmented permeable mass of particles containing oil shale and carbonate of magnesium in an in situ oil shale retort by introducing an oxygen-containing gas into the fragmented mass on a trailing side of the combustion zone and withdrawing an off gas from the fragmented mass on an advancing side of the combustion zone, whereby gas flowing through the combustion zone transfers heat of combustion to a retorting zone in the fragmented mass on the advancing side of the combustion zone and wherein kerogen in the oil shale in the retorting zone in decomposed to produce gaseous and liquid products including shale oil and carbonaceous residue, said carbonaceous residue supporting combustion in the combustion zone;

controlling the maximum temperature of particles in the fragmented mass in the range of about 600° C. to 800° C. during advancement of the combustion zone through the fragmented mass for calcining at least a portion of the carbonate of magnesium in the fragmented mass to magnesium oxide;

flooding at least a portion of the fragmented mass with an aqueous leaching agent containing sufficient dissolved carbon dioxide at temperatures in the range of about 10° C. to 60° C. for dissolving magnesium oxide and forming enriched solution containing magnesium values;

flowing carbon dioxide containing gas upwardly through the flooded portion of the fragmented mass, the partial pressure of carbon dioxide being at least about one atmosphere near the bottom of the fragmented mass;

withdrawing enriched solution containing magnesium values from the fragmented mass; and recovering magnesium values from such enriched solution.

46. A method as recited in claim 45 which comprises controlling the maximum temperature of particles in the fragmented mass in the range of from about 600° C. to 730° C. during advancement of the combustion zone through the fragmented mass.

47. A method as recited in claim 45 in which the particles in the fragmented mass have a weight average diameter in the range of from about 2 to 18 inches.

48. A method for recovering shale oil and leaching magnesium values from formation particles in an in situ oil shale retort in a subterranean formation containing oil shale and magnesium values which comprises:

advancing a combustion zone through a first fragmented permeable mass of formation particles containing oil shale and magnesium values in a first in situ oil shale retort by introducing an oxygen containing gas to the fragmented mass on a trailing side of the combustion zone and withdrawing an off gas from the fragmented mass on an advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including shale oil and carbonaceous residue, such carbonaceous residue supporting combustion in the combustion zones at sufficient temperatures for converting at least a portion of the oil shale in the first fragmented mass to a form from which magnesium values can be leached;

advancing a combustion zone through a second fragmented permeable mass of formation particles containing oil shale in a second in situ oil shale retort by introducing an oxygen-containing gas into the second fragmented mass on a trailing side of the combustion zone and withdrawing a carbon dioxide containing off gas from the second fragmented mass on an advancing side of the combustion zone;

cooling the first fragmented mass after advancement of the combustion zone therethrough;

selectively leaching magnesium values from such a cooled first fragmented mass by contacting at least a portion of such cooled first fragmented mass with aqueous leaching agent comprising dissolved carbon dioxide and introducing at least a portion of such off gas from such a second in situ oil shale retort into such a portion of such a first cooled fragmented mass for forming enriched solution containing dissolved carbon dioxide and magnesium values;

withdrawing enriched solution containing magnesium values from the first retort; and recovering magnesium values from such enriched solution.

49. A method as recited in claim 48 which comprises extracting carbon dioxide from such off gas from such a second in situ oil shale retort and introducing such extracted carbon dioxide to the first fragmented mass.

50. A method as recited in claim 48 wherein off gas from such a second in situ oil shale retort contains combustible gaseous products and which comprises the steps of burning such combustible gaseous products in such off gas and introducing at least a portion of such burned off gas to the first fragmented mass.

51. A method as recited in claim 48 wherein off gas from such a second in situ oil shale retort contains combustible gaseous products and which comprises the steps of compressing such off gas to an elevated pressure, burning such combustible gaseous products in such off gas to produce burned off gas at such an elevated pressure, extracting carbon dioxide from such burned off gas at such an elevated pressure, and introducing at least a portion of such extracted carbon dioxide to the first fragmented mass.

52. A method as recited in claim 48 which comprises flowing such off gas from such a second in situ oil shale retort upwardly through the first fragmented mass and flowing aqueous liquid downwardly through the first fragmented mass.

53. A method as recited in claim 48 which comprises dissolving carbon dioxide from such off gas withdrawn from such a second in situ oil shale retort to form an acidic aqueous leaching agent containing dissolved carbon dioxide and introducing such leaching agent into the fragmented mass.

54. A method as recited in claim 48 which comprises controlling the maximum temperature of particles in the first fragmented mass in the range of from about 600° C. to 800° C. during advancement of the combustion zone through the first fragmented mass.

55. A method as recited in claim 48 which comprises controlling the maximum temperature of particles in the fragmented mass in the range of from about 600° C. to 700° C. during advancement of the combustion zone through the fragmented mass.

56. A method for recovering shale oil and leaching magnesium values from particles containing oil shale and carbonated magnesium which comprises:

retorting such particles for decomposing kerogen in oil shale to produce gaseous and liquid products including shale oil and heating retorted particles at a maximum temperature sufficient for converting oil shale to a form from which magnesium values can be leached;

contacting such retorted heat particles with an aqueous solution containing sufficient dissolved carbon dioxide for selectively leaching magnesium values from the particles and for forming an enriched solution containing dissolved carbon dioxide and such magnesium values;

separating such enriched solution from the particles; and recovering magnesium values from such enriched solution.

57. A method as recited in claim 56 wherein the retort particles are heated at a maximum temperature in the range of from about 600° C. to 800° C.

58. A method as recited in claim 56 wherein the retorted particles are heated at a maximum temperature in the range of about 600° C. to 700° C.

59. A method as recited in claim 56 wherein the carbonaceous residue is combusted for heating retorted particles for enhancing the selective leachability of the magnesium values.

60. A method for recovering shale oil and leaching magnesium values from formation particles in an in situ oil shale retort in a subterranean formation containing oil shale and magnesium values which comprises:

advancing a combustion zone through a fragmented permeable mass of formation particles containing oil shale and magnesium values in an in situ oil shale retort by introducing an oxygen-containing gas to the fragmented mass on the trailing side of the combustion zone and withdrawing an off gas from the fragmented mass on the advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including shale oil and carbonaceous residue, such carbonaceous residue supporting combustion in the combustion zone at a maximum temperature below a temperature which promotes formation of a mineral crystal barrier on the particles during leaching;

selectively leaching magnesium values from at least a portion of the fragmented mass by contacting particles in the fragmented mass with an acidic aqueous leaching agent containing dissolved purgeable acid-forming gas for forming enriched solution containing magnesium values;

withdrawing enriched solution containing magnesium values from the retort; and recovering magnesium values from such enriched solution.

61. A method as recited in claim 60 in which the leaching agent contains sufficient dissolved carbon dioxide for forming enriched solution containing dissolved magnesium bicarbonate.

62. A method as recited in claim 60 which comprises controlling the maximum temperature of particles in the fragmented mass in the range of from about 600° C. to 800° C. during advancement of the combustion zone through the fragmented mass.

63. A method as recited in claim 60 which comprises controlling the maximum temperature of particles in the fragmented mass in the range of from about 600° C. to 730° C. during advancement of the combustion zone through the fragmented mass.

64. A method for recovering shale oil and magnesium values from formation particles in an in situ oil shale retort in a subterranean formation containing oil shale which comprises:

advancing a combustion zone through a fragmented permeable mass of formation particles containing oil shale and carbonates of magnesium and calcium in an in situ oil shale retort by introducing an oxygen-containing gas to the fragmented mass on a trailing side of the combustion zone and withdrawing an off gas from the fragmented mass on an advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including shale oil and carbonaceous residue, said carbonaceous residue supporting combustion in the combustion zone;

controlling conditions in the retort during retorting for converting oil shale in the retort to a form that is permeable to aqueous liquid and that substantially retains it permeability during leaching with acidic aqueous leaching agent;

cooling the fragmented mass after advancement of the combustion zone therethrough;

contacting at least a portion of the cooled fragmented mass with an aqueous leaching agent containing sufficient dissolved carbon dioxide for forming enriched solution containing dissolved carbon dioxide and magnesium values;

withdrawing enriched solution containing magnesium values from the fragmented mass; and recovering magnesium values from such enriched solution.

65. A method as recited in claim 64 in which the leaching agent contains sufficient dissolved carbon dioxide for forming enriched solution containing dissolved magnesium bicarbonate.

66. A method as recited in claim 64 wherein the step of controlling comprises controlling the maximum temperature of particles in the fragmented mass in the range of from about 600° C. to 800° C. during advancement of the combustion zone through the fragmented mass.

67. A method as recited in claim 64 wherein the step of controlling comprises controlling the maximum temperature of particles in the fragmented mass in the range of from about 600° C. to 730° C. during advancement of the combustion zone through the fragmented mass.

68. A method for recovering shale oil and leaching magnesium values from formation particles in an in situ oil shale retort in a subterranean formation containing oil shale which comprises:

advancing a combustion zone through a fragmented permeable mass of formation particles containing oil shale and carbonates of magnesium and calcium in an in situ oil shale retort by introducing an oxygen-containing gas to the fragmented mass on a trailing side of the combustion zone and withdrawing an off gas from the fragmented mass on an advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including shale oil and carbonaceous residue, said carbonaceous residue supporting combustion in the combustion zone;

controlling conditions in the retort during retorting for limiting the decomposition of calcium carbonate and preferentially converting magnesium carbonate to magnesium oxide, the decomposition of calcium carbonate being limited sufficiently for retarding or avoiding the growth of calcium mineral crystals on the particles during leaching;

cooling the fragmented mass after advancement of the combustion zone therethrough;

contacting at least a portion of the cooled fragmented mass with an aqueous leaching agent containing sufficient dissolved carbon dioxide for forming enriched solution containing dissolved carbon dioxide and magnesium values;

withdrawing enriched solution containing magnesium values from the fragmented mass; and recovering magnesium values from such enriched solution.

69. A method as recited in claim 68 in which the leaching agent contains sufficient dissolved carbon dioxide for forming enriched solution containing dissolved magnesium bicarbonate.

70. A method as recited in claim 68 wherein the step of controlling comprises controlling the maximum temperature of particles in the fragmented mass in the range of from about 600° C. to 800° C. during advancement of the combustion zone through the fragmented mass.

71. A method as recited in claim 68 wherein the step of controlling comprises controlling the maximum temperature of particles in the fragmented mass in the range of from about 600° C. to 730° C. during advancement of the combustion zone through the fragmented mass.

* * * * *